US009123995B2

(12) United States Patent
Leung et al.

(10) Patent No.: US 9,123,995 B2
(45) Date of Patent: Sep. 1, 2015

(54) DIELECTRIC ANTENNA AND METHOD OF DISCRETELY EMITTING RADIATION PATTERN USING SAME

(75) Inventors: Kwok Wa Leung, Shatin (HK); Xiaosheng Fang, Kowloon (HK); Eng Hock Lim, Kapar (MY)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 247 days.

(21) Appl. No.: 13/615,121

(22) Filed: Sep. 13, 2012

(65) Prior Publication Data

US 2013/0234898 A1 Sep. 12, 2013

Related U.S. Application Data

(60) Provisional application No. 61/607,534, filed on Mar. 6, 2012.

(51) Int. Cl.

| | |
|---|---|
| ***H01Q 1/36*** | (2006.01) |
| ***H01Q 1/44*** | (2006.01) |
| ***H01Q 9/04*** | (2006.01) |

(52) U.S. Cl.
CPC . *H01Q 1/36* (2013.01); *H01Q 1/44* (2013.01); *H01Q 9/0485* (2013.01)

(58) Field of Classification Search
CPC ..... H01Q 1/44; H01Q 9/0485
USPC ..... 343/700 R
See application file for complete search history.

(56) References Cited

U.S. PATENT DOCUMENTS

| | | | | |
|---|---|---|---|---|
| 4,788,550 | A | 11/1988 | Chadima, Jr. | 343/712 |
| 4,978,964 | A | 12/1990 | Castille | 343/715 |
| 5,268,703 | A | 12/1993 | Wingard | 343/895 |
| 5,836,261 | A | 11/1998 | Sutton | 116/209 |
| 6,063,459 | A | 5/2000 | Velte | 428/31 |
| 6,247,423 | B1 | 6/2001 | Ingram et al. | 116/28 R |
| 6,373,441 | B1 | 4/2002 | Porath et al. | 343/753 |
| 6,377,222 | B1 | 4/2002 | Nicholson | 343/713 |
| 6,441,799 | B2 | 8/2002 | Spaulding | 343/872 |
| 6,456,255 | B1 | 9/2002 | Lundahl | 343/872 |

(Continued)

FOREIGN PATENT DOCUMENTS

| | | | |
|---|---|---|---|
| CN | 101473491 | A | 7/2009 |
| CN | 102195125 | A | 9/2011 |
| WO | WO 03007425 | A1 * | 1/2003 |

(Continued)

OTHER PUBLICATIONS

Zhi Ning Chen; See, T.S.P.; Xianming Qing, "Small Printed Ultrawideband Antenna With Reduced Ground Plane Effect," Antennas and Propagation, IEEE Transactions on , vol. 55, No. 2, pp. 383,388, Feb. 2007.*

(Continued)

*Primary Examiner* — Sue A Purvis
*Assistant Examiner* — Amal Patel
(74) *Attorney, Agent, or Firm* — Heslin Rothenberg Farley & Mesiti P.C.

(57) ABSTRACT

An aesthetic dielectric antenna (e.g., a dielectric resonator antenna) includes an aesthetically shaped decoration having at least one shaped dielectric (swan, apple or building shape) with a dielectric constant of more than one. A waveguide, feedline, probe or other means of excitation is electronically coupled to the dielectric to emit a radiation pattern for carrying analog or digital information.

28 Claims, 9 Drawing Sheets

(56) References Cited

U.S. PATENT DOCUMENTS

| | | | | |
|---|---|---|---|---|
| 6,598,556 | B1 | 7/2003 | Peters | 116/50 |
| 7,071,879 | B2 | 7/2006 | Strickland | 343/700 MS |
| 7,161,555 | B2 * | 1/2007 | Ohno et al. | 343/911 R |
| 7,238,398 | B2 | 7/2007 | Colson | 428/31 |
| 7,443,363 | B2 * | 10/2008 | Ying | 343/911 R |
| 2011/0215973 | A1 | 9/2011 | Hsieh et al. | |

FOREIGN PATENT DOCUMENTS

| | | | |
|---|---|---|---|
| WO | W02007147446 | A1 | 12/2007 |
| WO | WO 2008043369 | A1 * | 4/2008 |

OTHER PUBLICATIONS

Rudolf F. Graf; "Modern Dictionary of Electronics," Seventh Edition, p. 745, Jul. 1999.*

* cited by examiner

DIELECTRIC ANTENNA AND METHOD OF DISCRETELY EMITTING RADIATION PATTERN USING SAME

CROSS-REFERENCE TO RELATED APPLICATIONS

This application claims priority under 35 U.S.C. §119 to U.S. Provisional Application No. 61/607,534, filed Mar. 6, 2012, which is herein incorporated by reference in its entirety.

BACKGROUND OF THE INVENTION

Background Information

Due to the rapid development of wireless communications, base station antennas can be easily found in our daily life. Normally, these antennas have a much higher radiation power than mobile-phone antennas. Therefore, people may have psychological concerns if base station antennas are in close proximity to them. As a result, some antennas are deliberately hidden to avoid potential psychological problems.

For example, some cellular towers are camouflaged to blend in with the surroundings by, e.g., painting or adding artificial tree limbs and the like. The antenna tower itself is still conventionally shaped, but simply covered to minimize recognition of the tower by the human eye. These types of solutions are for antennas placed in the distance. Antennas intended to be closer to people may still not be appealing when covered.

Thus, a need exists for a way to improve the aesthetics of antennas when in proximity of people.

SUMMARY OF THE INVENTION

Briefly, the present invention satisfies the above need by providing a dielectric antenna integrated with a decoration, such that it is perceived as simply a decoration.

The present invention provides, in a first aspect, a dielectric antenna. The dielectric antenna comprises at least one swan-shaped dielectric having a dielectric constant of more than 1. The dielectric antenna further comprises a substrate on which the at least one swan-shaped dielectric is situated, and means electronically coupled via the substrate to the at least one swan-shaped dielectric for exciting the dielectric to emit a radiation pattern for carrying information, each of the at least one swan-shaped dielectric being a three-dimensional aesthetically decorative shaped sculpture or artwork. The at least one swan-shaped dielectric comprises a stationary swan having a head, a beak, an S-shaped neck, a pair of wings, a body and a tail, an overall height of the swan-shaped dielectric being approximately equal to an overall length thereof from a tip of the beak to a tip of the tail, a length from an outermost point of a base of the neck to the tip of the tail comprising approximately 64.5% to approximately 88.5% of the overall height and overall length, a height from a tip of the wings to a bottom surface of the body comprising approximately 77.4% to about 79.2% of the overall height and overall length, a height from a top of the head to a top of the neck comprising approximately 2.2% to about 2.3% of the overall height and overall length, a height from the tip of the beak to the top of the head comprising approximately 20.3% to about 20.8% of the overall height and overall length, a height from the bottom surface of the body to the tip of the tail comprising approximately 24.8% to about 25.4% of the overall height and overall length, a width of the head comprising approximately 9.8% to about 10% of the overall height and overall length, a width from wing tip to wing tip comprising approximately 42.9% to about 43.8% of the overall height and overall length, a width from an inner surface of one wing to an inner surface of the other wing comprising approximately 32.3% to about 33.1% of the overall height and overall length, a width of the base of the neck comprising approximately 9.8% to about 10% of the overall height and overall length, a width of the bottom surface of the body comprising approximately 25.6% to about 26.2% of the overall height and overall length, a width of each wing comprising approximately 7.5% to about 7.7% of the overall height and overall length, and a width of the body comprising approximately 38.3% to about 39.2% of the overall height and overall length. When excited the swan-shaped dielectric resonates at about 1.83 GHz with a bandwidth of about 1.57 GHz to about 2.16 GHz. The information carried may be digital or analog in nature.

The present invention provides, in a second aspect, a method of discretely emitting a radiation pattern capable of carrying information. The method comprises providing a dielectric antenna, comprising at least one swan-shaped dielectric having a dielectric constant of more than 1, a substrate on which the at least one swan-shaped dielectric is situated, and means electronically coupled via the substrate to the at least one swan-shaped dielectric for exciting the dielectric to emit a radiation pattern for carrying information, each of the at least one swan-shaped dielectric being a three-dimensional aesthetically decorative shaped sculpture or artwork. The method further comprises exciting the at least one swan-shaped dielectric with the exciting means to emit a radiation pattern capable of carrying information. The at least one swan-shaped dielectric comprises a stationary swan having a head, a beak, an S-shaped neck, a pair of wings, a body and a tail, an overall height of the swan-shaped dielectric being approximately equal to an overall length thereof from a tip of the beak to a tip of the tail, a length from an outermost point of a base of the neck to the tip of the tail comprising approximately 86.5% to approximately 88.5% of the overall height and overall length, a height from a tip of the wings to a bottom surface of the body comprising approximately 77.4% to about 79.2% of the overall height and overall length, a height from a top of the head to a top of the neck comprising approximately 2.2% to about 2.3% of the overall height and overall length, a height from the tip of the beak to the top of the head comprising approximately 20.3% to about 20.8% of the overall height and overall length, a height from the bottom surface of the body to the tip of the tail comprising approximately 24.8% to about 25.4% of the overall height and overall length, a width of the head comprising approximately 9.8% to about 10% of the overall height and overall length, a width from wing tip to wing tip comprising approximately 42.9 to about 43.8% of the overall height and overall length, a width from an inner surface of one wing to an inner surface of the other wing comprising approximately 32.3% to about 33.1% of the overall height and overall length, a width of the base of the neck comprising approximately 9.8% to about 10% of the overall height and overall length, a width of the bottom surface of the body comprising approximately 25.6% to about 26.2% of the overall height and overall length, a width of each wing comprising approximately 7.5% to about 7.7% of the over height and overall length, and a width of the body comprising approximately 38.3% to about 39.2% of the overall height and overall length. When excited the swan-shaped dielectric resonates at about 1.83 GHz with a bandwidth of about 1.57 GHz to about 2.16 GHz. The information carried may be digital or analog in nature.

Apple-shaped and building-shaped embodiments are also provided.

These, and other objects, features and advantages of this invention will become apparent from the following detailed description of the various aspects of the invention taken in conjunction with the accompanying drawings.

DETAILED DESCRIPTION OF THE INVENTION

In the last two decades, tremendous efforts have been made to study Dielectric Resonator Antennas (DRAs), which have a number of attractive features, such as small size, light weight, low loss, and ease of excitation. DRAs can be made of any dielectric materials (preferably having a dielectric constant of more than one), such as ceramics and composite materials (e.g., fiberglass). Since glass DRAs are transparent, they do not block light and can therefore be used with solar panels.

In this invention, a dielectric antenna (including a Dielectric Resonator Antenna DRA) is integrated with a decoration artwork such as, for example, statue, dummy, idol, animal, and vase. Any dielectric materials with a dielectric constant greater than one, such as crystal and glass, can be used for its design. Crystal and glass wares or artworks are often seen at homes and offices for decoration purposes. With this invention, beautiful crystal and glass wares or artworks can be employed as antennas. This is useful when stand-alone or visible antennas are not wanted. The latter is particularly important to avoid possible uneasy feelings if the antenna is in close proximity to people.

Figure 10:
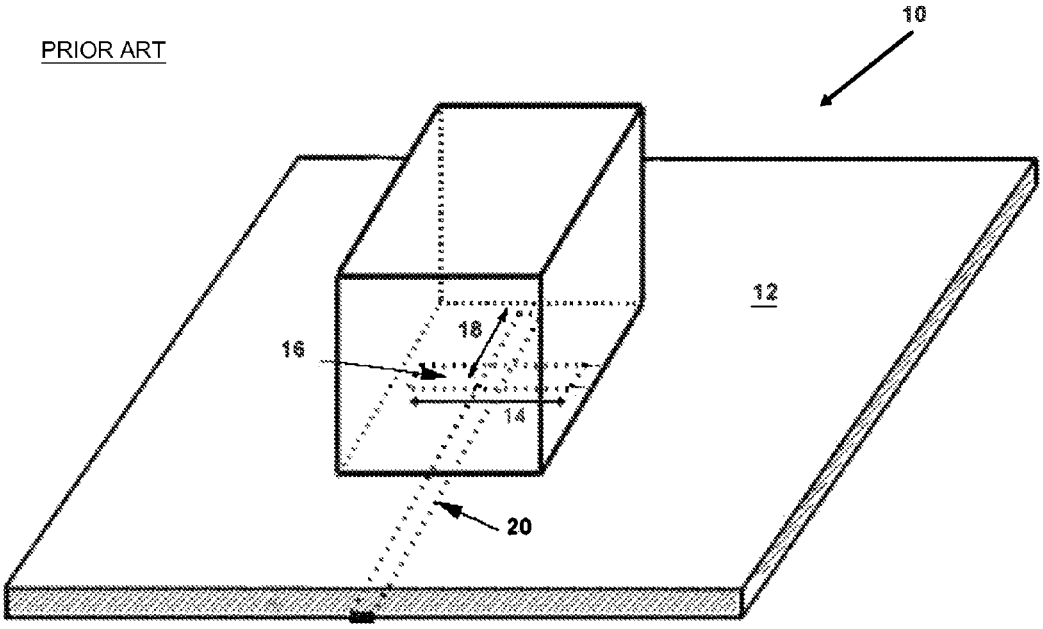
FIG. 10 is an example of a slot-coupled rectangular dielectric resonator antenna.

DRAs can be excited with different feeding schemes, such as a coaxial probe, a coupling slot, a microstripline, a coplanar waveguide, a conformal strip, a dielectric image guide, and a metallic waveguide. The slot-coupled method with a microstrip feedline is perhaps most popular among them. An example of a slot-coupled rectangular DRA 10 is shown in FIG. 10. This excitation method is popular because it allows direct integration of an antenna with a microwave circuit (not shown). Furthermore, it isolates the antenna from the circuit by virtue of the ground plane 12, and avoids the need for drilling a hole in a DR as required by the probe-fed method. Also, matching the DRA is very easy by simply varying the length 14 of the slot 16 and the stub length 18 of the microstrip 20.

In general, a DRA is operated in its fundamental broadside or endfire mode. The former can be obtained by exciting the DRA with a displaced probe or a slot as shown in FIG. 10. In this case, the DRA radiates like a magnetic dipole with its maximum radiation fields being normal to the ground plane. Radiation fields of the latter are similar to those of an electric monopole antenna. This mode can be excited by axially feeding the DRA with a coaxial probe. Theoretically, its radiated E-field is maximum along the ground plane direction, but practically it has a tilting angle due to the finite-ground-plane effect.

Crystal and glass wares have long been widely used in homes and offices for decorating purposes. As compared with glass, lead crystal comprises approximately 24%-30% lead oxide, causing it to have a higher reflective index that makes it sparkle when cut at sharp angles. It is also the lead oxide that makes crystal heavier, but softer than glass. Since crystals are basically glass, it is believed that it can also be used for DRA designs. In other words, beautiful crystal and glass wares or artworks can be employed as antennas.

Figure 1A:
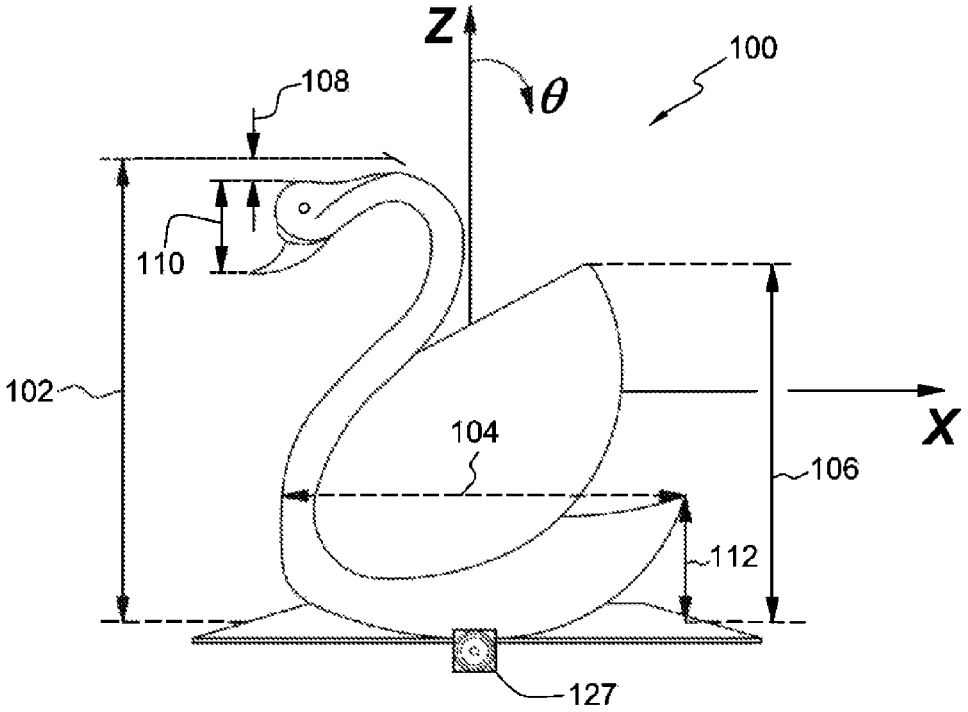
FIGS. 1(*a*)-1(*d*) depict one example of an aesthetic dielectric antenna according to the invention, in this case, a glass swan dielectric antenna.
Figure 1B:
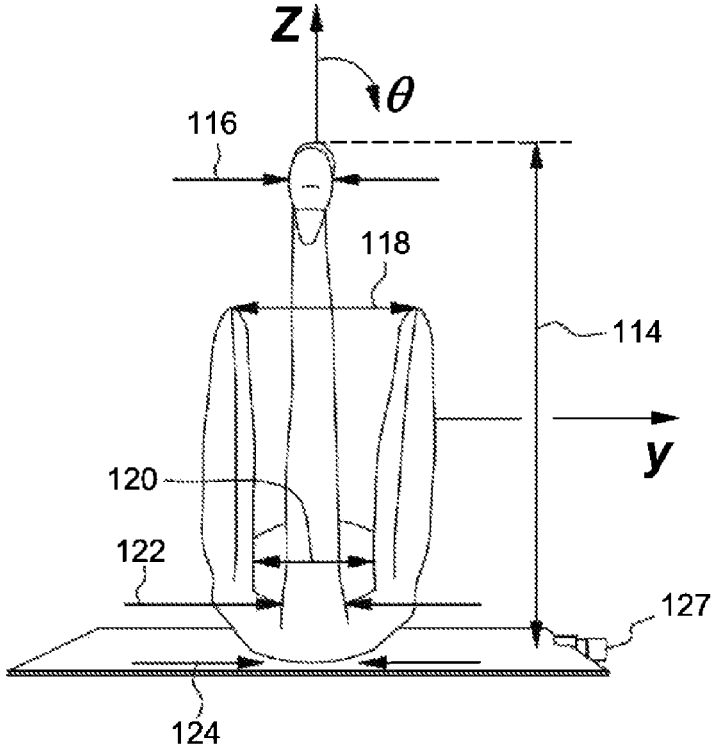
Figure 1C:
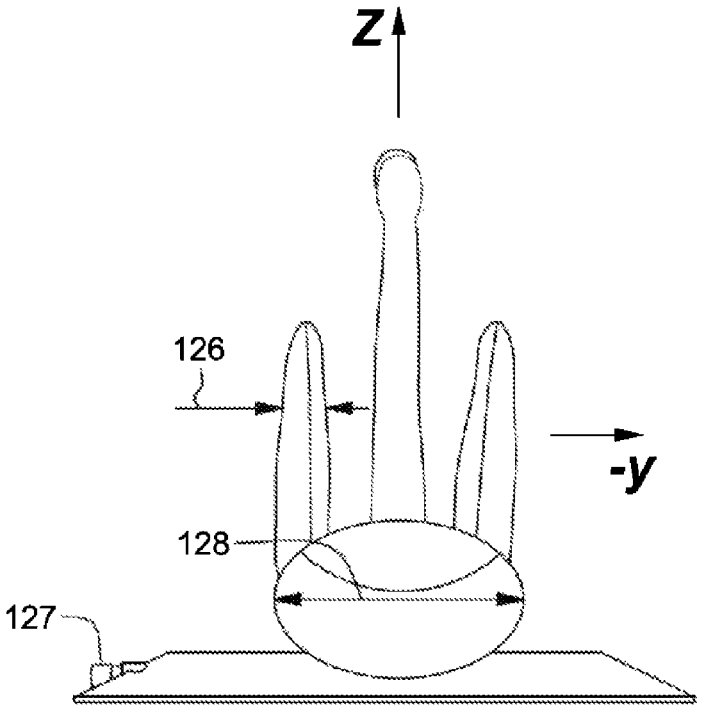
Figure 1D:
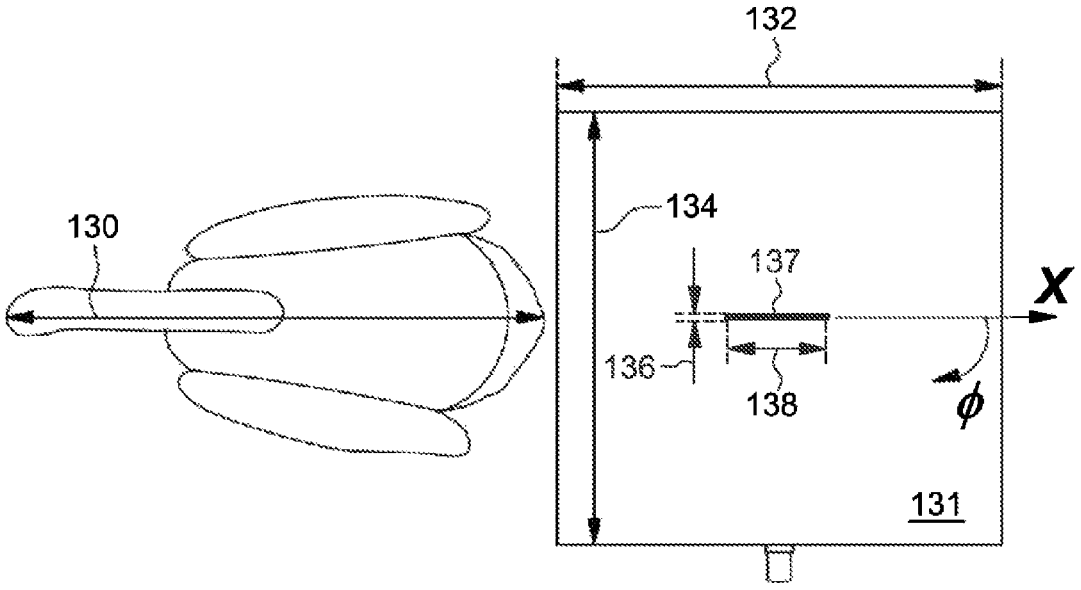
Figure 2A:
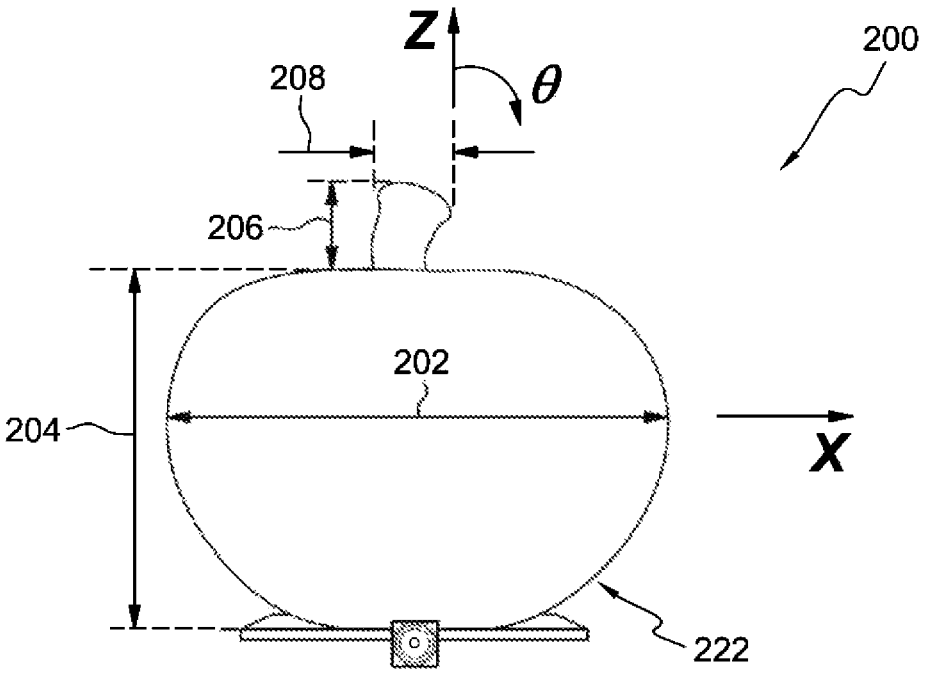
FIGS. 2(*a*) and 2(*b*) depict one example of an aesthetic dielectric antenna according to the invention, in this case, a glass apple dielectric antenna.
Figure 2B:
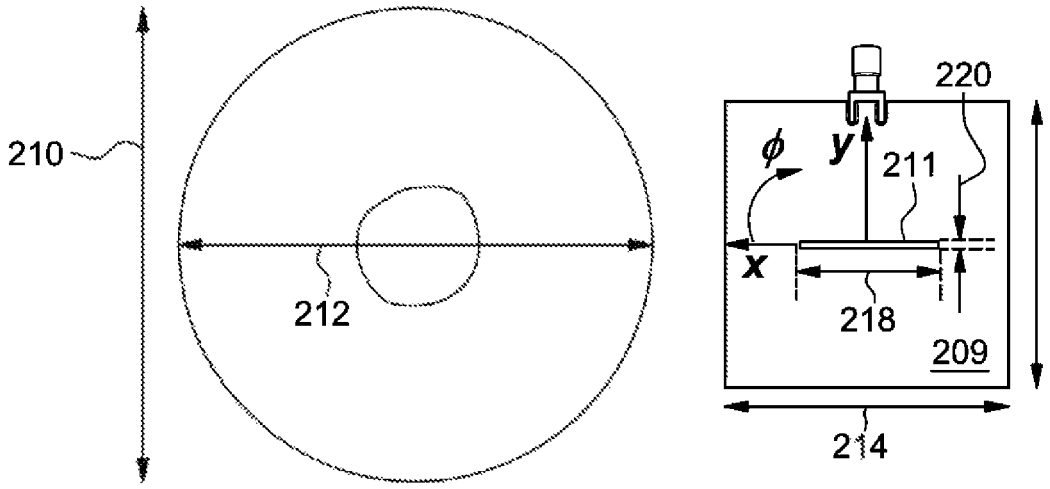

A glass swan and glass apple were obtained and measured. Both of them are made of K-9 glass. FIGS. 1 and 2 show different views of the swan and apple antennas. In these examples, the slot-coupled method is used to excite them. Of course, other methods could be used, and the present invention contemplates those as well.

FIGS. 1(*a*)-1(*d*) depict the glass swan antenna 100. The dimensions of the swan antenna in FIG. 1(*a*) are given by the following reference numerals: 102=133 mm; 104=115 mm; 106=103 mm; 108=3 mm; 110=27 mm; and 112=33 mm. The dimensions of FIG. 1(*b*) are as follows: 114=133 mm; 116=13 mm; 118=57 mm; 120=43 mm; 122=13 mm; and 124=34 mm. FIG. 1(*c*) has the following dimensions: 126=10 mm; and 128=51 mm. Finally, FIG. 1(*d*) has the following dimensions: 130=130 mm; 132=140 mm; 134=140 mm; 136=2 mm; and 138=32 mm.

FIGS. 2(*a*) and 2(*b*) depict the glass apple antenna 200. The dimensions of the apple antenna in FIG. 2(*a*) are given by the following reference numerals: 202=75 mm; 204=49 mm; 206=20 mm; and 208=11 mm. FIG. 2(*b*) has the following dimensions: 210=75 mm; 212=75 mm; 214=50 mm; 216=50 mm; 218=25 mm; and 220=2 mm.

The swan antenna 100 is fed at the mid-point of its length (130, FIG. 1(*d*)) by a coupling slot 137 on a substrate 131, the slot having a length 138 and width 136. The microwave substrate has a dielectric constant of 2.33, a thickness (not shown) of 1.57 mm, and a size (132, 134, FIG. 1(*d*)) of 14×14 $cm^2$. A 50-Ω microstrip feedline (not shown) with a width of 4.7 mm and a stub length of 10 mm is printed in the substrate to energize the slot via coaxial feed 127 in FIGS. 1(*a*)-1(*c*).

The configuration of the apple antenna 200 is shown in FIGS. 2(*a*) and 2(*b*). Similar to the swan antenna, the apple antenna is fed at the center of its bottom (222, FIG. 2(*a*)) via substrate 209 by a coupling slot 211 of length 218, width 220 and stub length of 9 mm (not shown). The same type of substrate is used for this part, but the substrate size (214, 216 FIG. 2(*b*)) is reduced to 5×5 $cm^2$ because the apple antenna is much smaller and simpler than the swan antenna.

Figure 3:
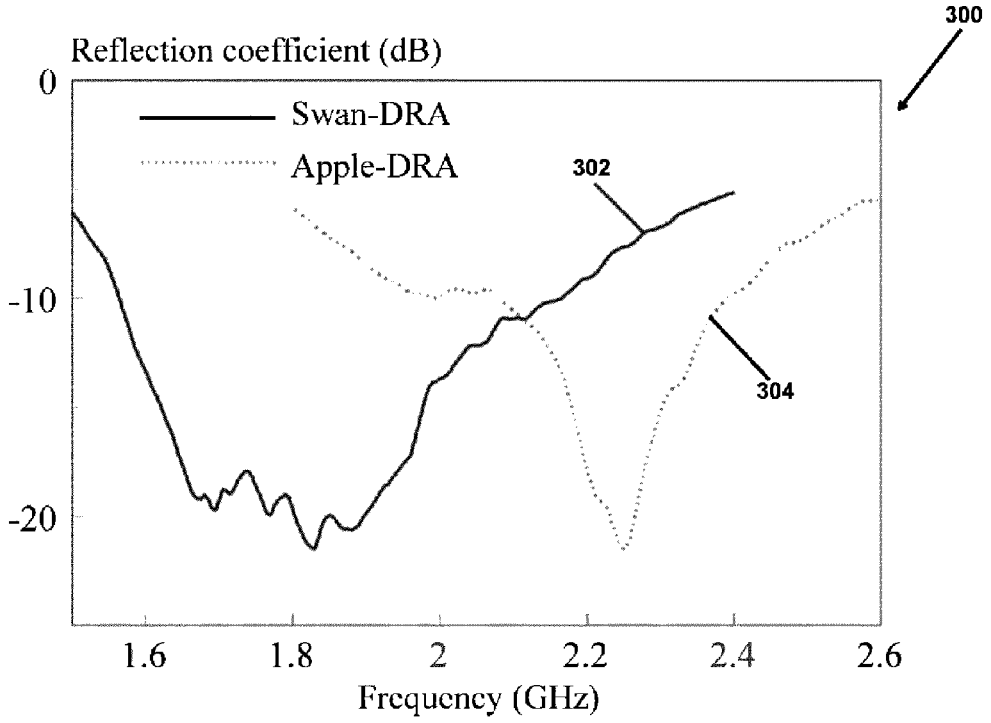
FIG. 3 is a graph of the measured reflection coefficients of the swan and apple antennas of FIGS. 1(*a*)-1(*d*), 2(*a*) and 2(*b*).

FIG. 3 is a graph 300 of the measured reflection coefficients of the swan 302 and apple 304 antennas. With reference to the figure, the swan and apple antennas resonate at 1.83 GHz and 2.25 GHz, respectively. The bandwidth (≤−10 dB) of the swan antenna is 31.6% (1.57-2.16 GHz), i.e., 31.6% of the theoretical maximum which can coincidentally cover the useful Digital Communication System or DCS (1.71-1.88 GHz), as well as the Personal Communication System or PCS (1.85-1.99 GHz) bands. For the apple antenna, a measured bandwidth of 13.5% (2.08-2.38 GHz) is found. The frequency band can be shifted upward or downward by decreasing or increasing the apple size, respectively. The swan antenna has a much wider bandwidth than the apple antenna because the former has a large air region between its wings. An air region is an effective means to increase the bandwidth of a dielectric antenna.

Figure 4:
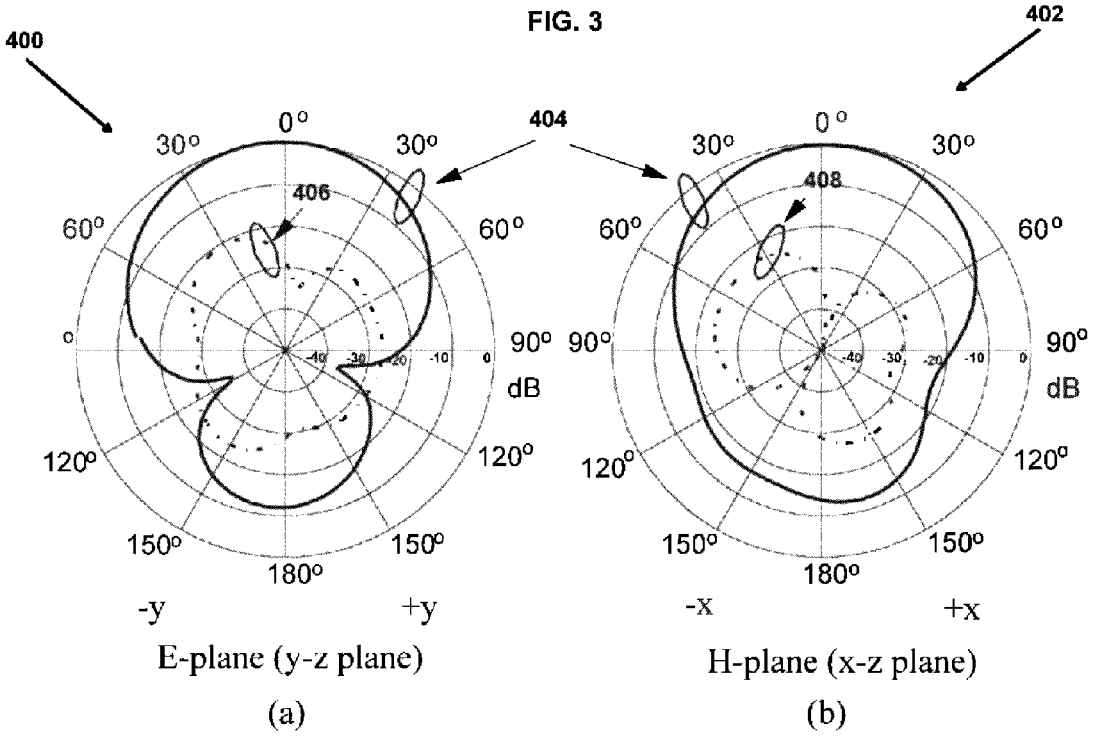
FIGS. 4(*a*) and 4(*b*) are graphs of the measured radiation patterns of the swan antenna in the E-plane and H-plane, respectively.

FIGS. 4(*a*) and 4(*b*) are graphs of the measured radiation patterns of the swan antenna in the E-plane (400, FIG. 4(*a*)) and H-plane (402, FIG. 4(*b*)), and typical broadside radiation patterns are observed. This result can be expected when a dielectric antenna is centrally fed by a coupling slot. For both E- and H-plane patterns, the co-polarized fields (404) are stronger than the cross-polarized fields (406, 408) by more than 20 dB in the boresight direction ($\theta=0°$).

Figure 5:
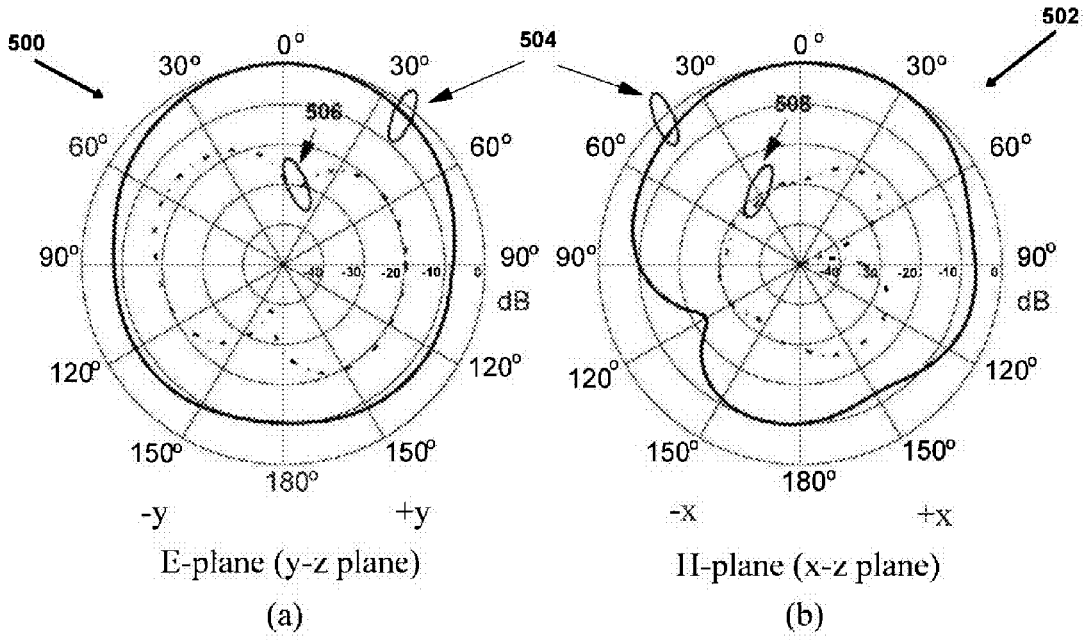
FIGS. 5(*a*) and 5(*b*) are graphs of the measured radiation patterns of the apple antenna in the E-plane and H-plane, respectively.

FIGS. 5(*a*) and 5(*b*) are graphs of the measured radiation patterns of the apple antenna in the E-plane (500, FIG. 5(*a*)) and H-plane (502, FIG. 5(*b*)). Again, broadside radiation patterns are observed, with the co-polarized fields 504 being stronger than the cross-polarized fields (506, 508) as expected.

Figure 6:
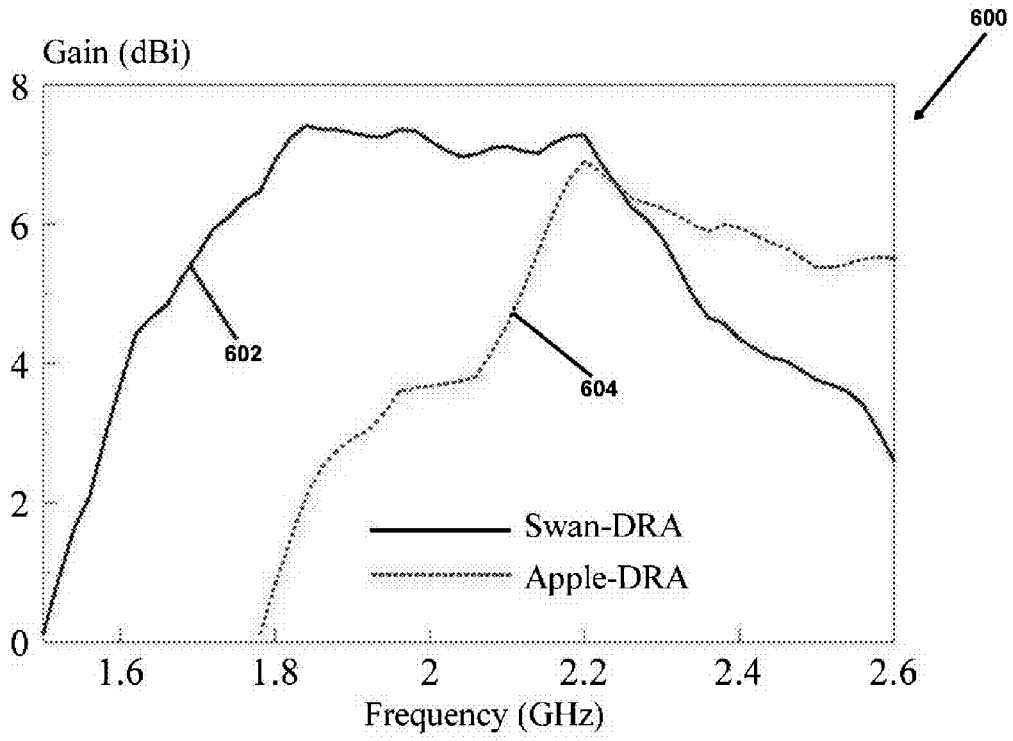
FIG. 6 is a graph of the measured gains of the swan and apple antennas.

FIG. 6 is a graph 600 of the measured gains (602 and 604) of the swan and apple antennas, respectively. With reference to the figure, the maximum gains of the swan and apple antennas are 7.4 dBi (1.84 GHz) and 6.88 dBi (2.2 GHz), respectively, showing the practicality of aesthetic dielectric (glass) antennas.

In the swan and apple embodiments, the DRA is excited by a microstripline-fed coupling slot, located at the center of its bottom. The DRAs are excited in their fundamental broadside radiation modes. In some applications, such as indoor wireless communications, however, omnidirectional radiation modes are usually preferred because they provide large signal coverage.

Figure 7A:
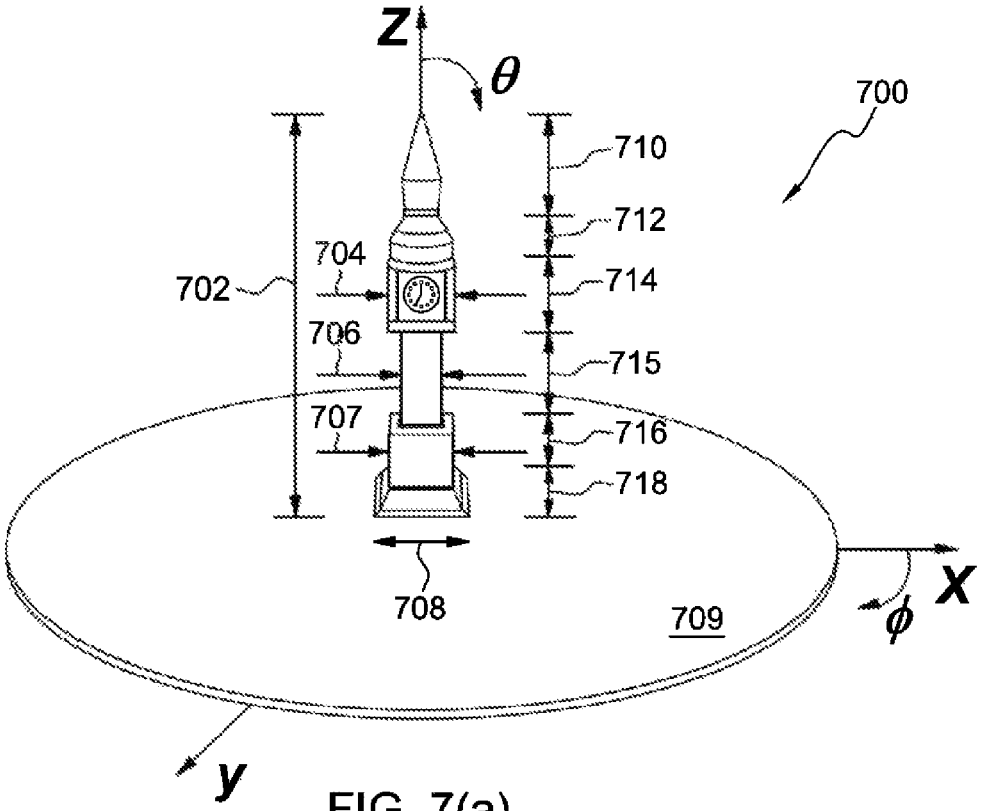
FIGS. 7(*a*) and 7(*b*) depict another example of an aesthetic dielectric antenna according to the invention, in this case, a glass building dielectric antenna.
Figure 7B:
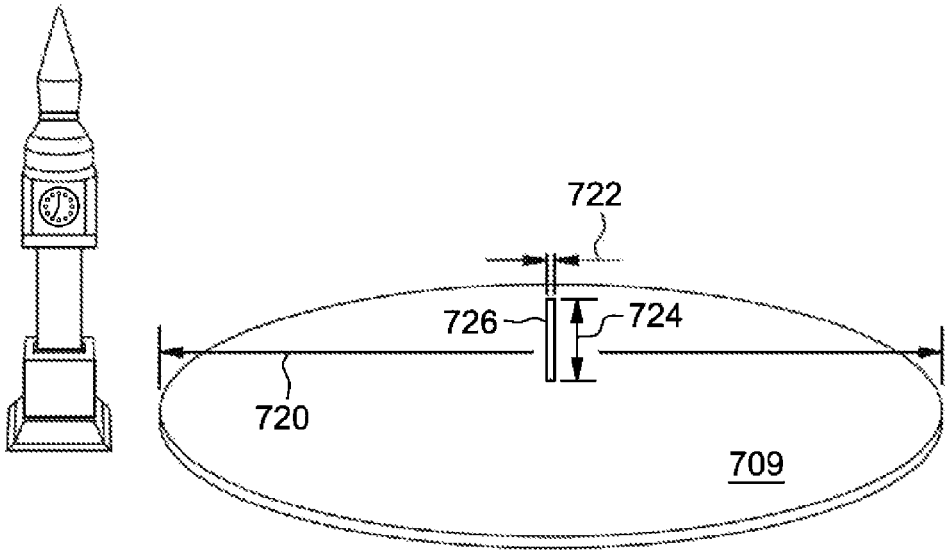

In another example, an omnidirectional aesthetic dielectric resonator antenna (DRA) in the shape of a building 700 is presented in FIGS. 7(*a*) and 7(*b*). The DRA is made of K-9 glass and is therefore transparent. It is generally sized for use as a home or office decoration. To obtain an omnidirectional radiation pattern, the DRA is excited by a probe at the center of its bottom. The reflection coefficient, radiation pattern, and antenna gain of the DRA were measured, and a wide impedance bandwidth of 36.5% was found. The reflection coefficient, radiation pattern, and antenna gain of the glass building DRA were also measured.

FIGS. 7(*a*) and 7(*b*) depict the glass building antenna 700. The dimensions of the building antenna in FIG. 7(*a*) are given by the following reference numerals: 702=93 mm; 704=14 mm; 706=9 mm; 707=14 mm; 708=21 mm; 710=23 mm; 712=12 mm; 714=14 mm; 715=25 mm; 716=14 mm; and 718=5 mm. FIG. 7(*b*) has the following dimensions: 720=190 mm; 722=1.27 mm; and 724=19 mm.

The building-shaped glass DRA 700 has a square bottom size of $21\times21$ mm$^2$, and is mounted on a circular ground plane 709 (in this example, a metallic ground plane) with a diameter 720 of 19 cm. The DRA is fed by a center coaxial probe 726, corresponding to the bottom center of the building. The probe has a length 724 and a radius of 0.635 mm (half of diameter 722). Since the probe is short as compared with the height of the DRA, it does not affect the appearance of the glass DRA significantly.

Figure 8:
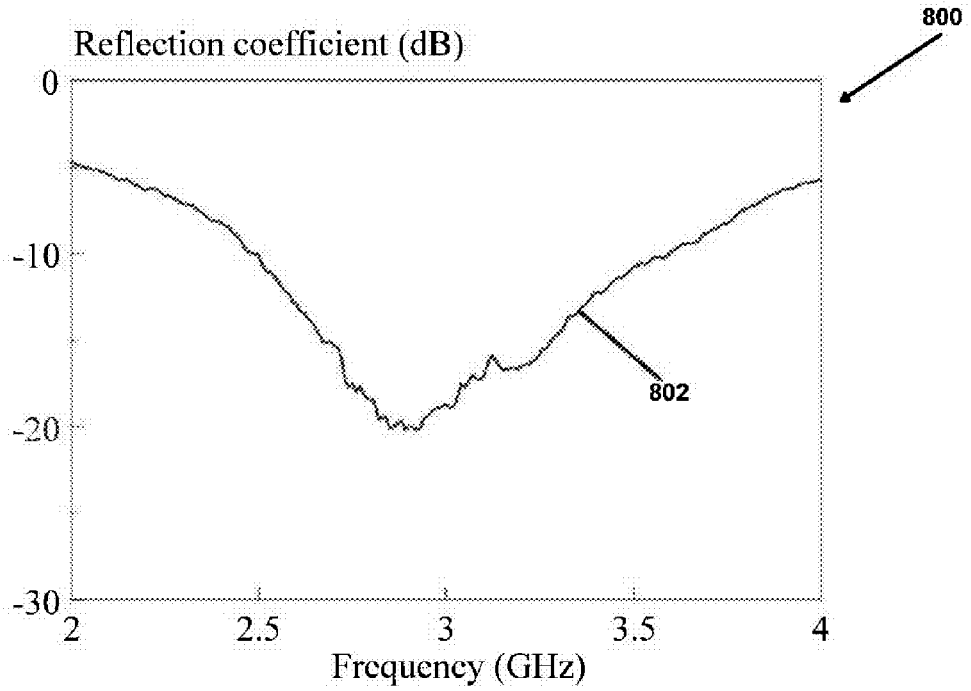
FIG. 8 is a graph of the measured reflection coefficient of the building-shaped dielectric antenna of FIGS. 7(*a*) and 7(*b*).

FIG. 8 is a graph 800 of the measured reflection coefficient 802 of the building-shaped glass DRA of FIGS. 7(*a*) and 7(*b*). With reference to FIG. 8, two resonant modes can be observed at 2.89 GHz and 3.15 GHz, characterized by oscillations in the measurements. These two modes merge together, giving a wide impedance bandwidth of 36.5% (2.48 GHz-3.59 GHz). It is worth mentioning that both of the resonant modes are caused by the DRA, the fundamental and first-harmonic frequencies of the feeding probe being about ~1.54 GHz and about ~4.61 GHz, respectively. These values were estimated using a dielectric constant of $\epsilon_r=6.6$.

Figure 9A:
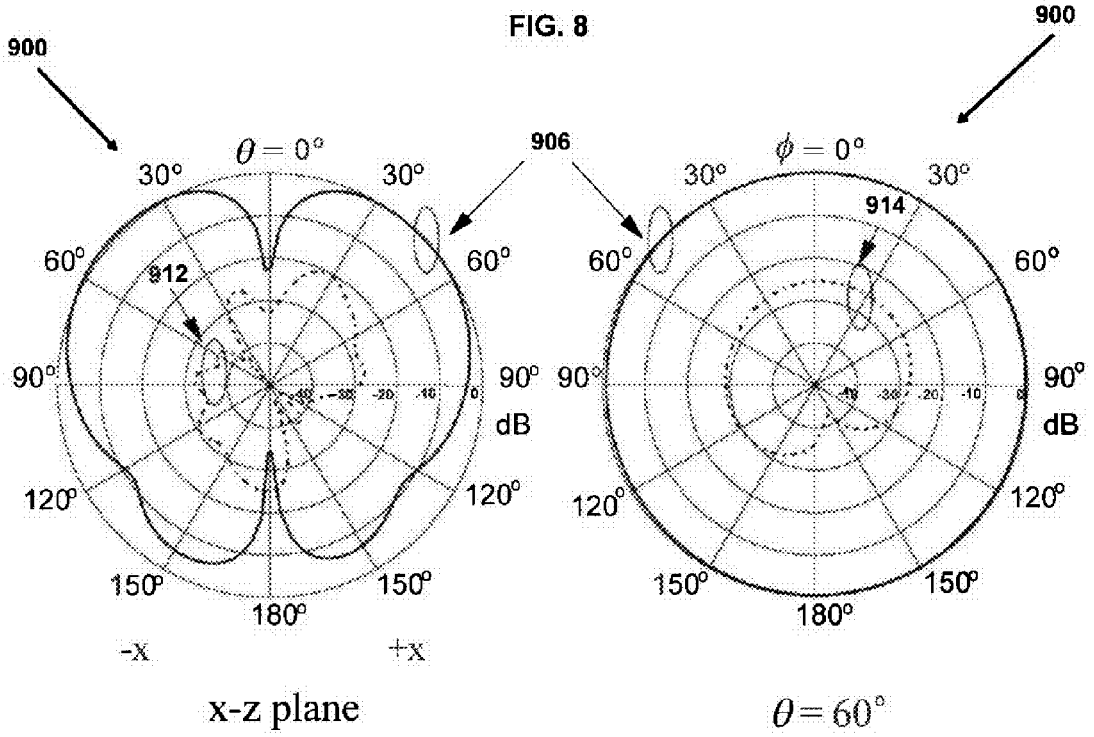
FIGS. 9(*a*)-9(*c*) are graphs of the measured radiation patterns of the building-shaped dielectric antenna at 2.48 GHz, 2.89 GHz and 3.59 GHz, respectively.
Figure 9B:
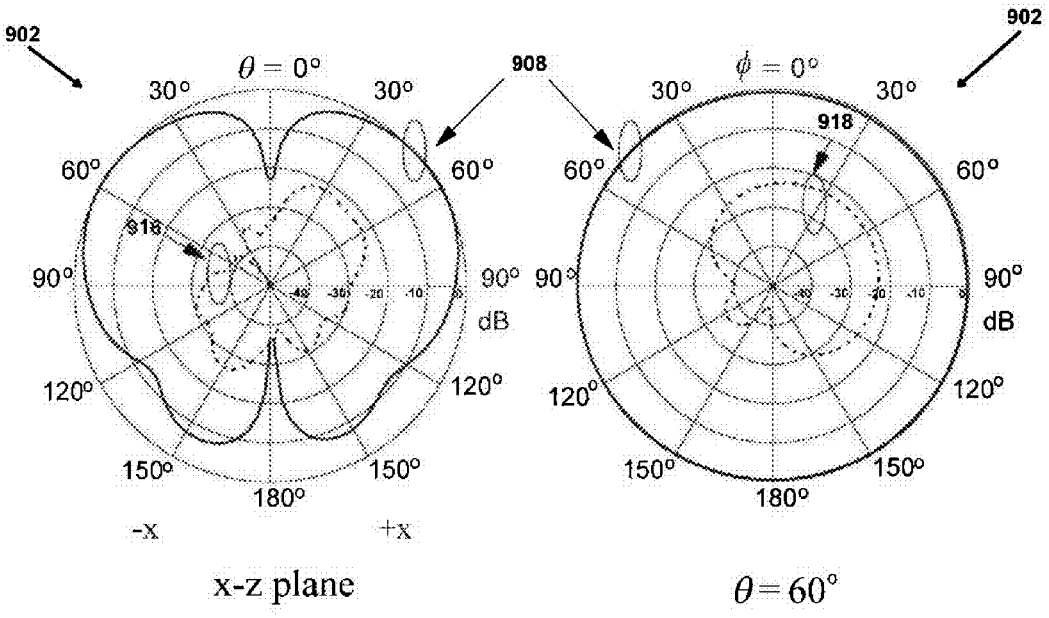
Figure 9C:
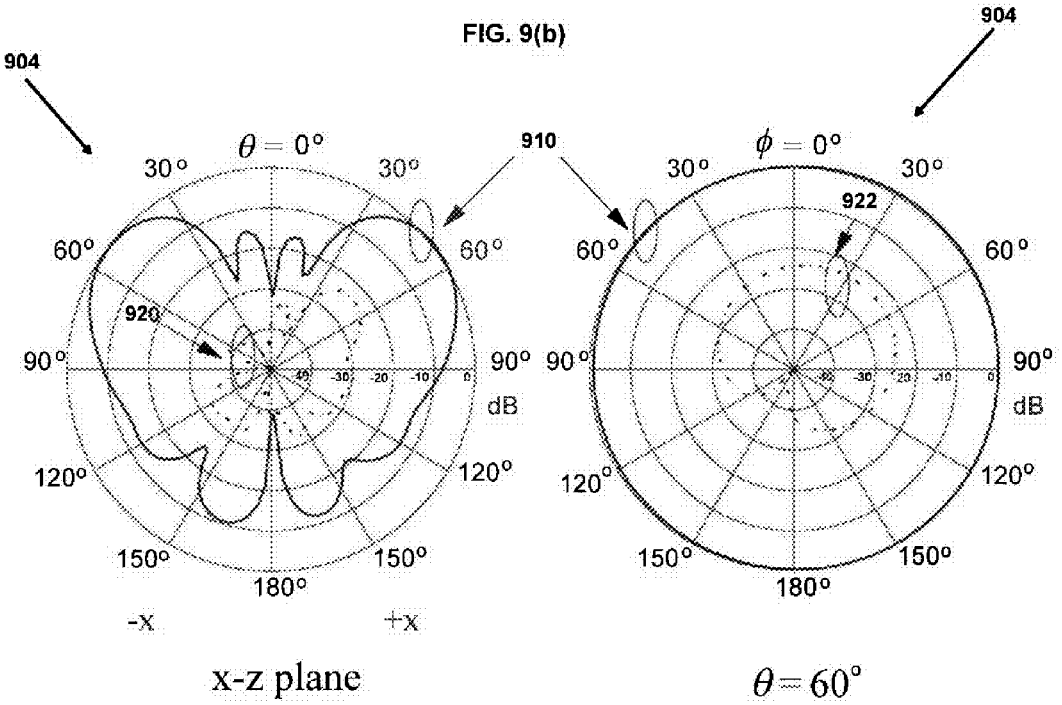

FIGS. 9(*a*)-9(*c*) are graphs 900, 902 and 904 of the measured radiation patterns of the glass building DRA at 2.48 GHz, 2.89 GHz, and 3.59 GHz, respectively. As can been seen from the figure, omnidirectional radiation patterns are observed at the three frequencies. As expected, the co-polarized fields (906, 908 and 910) are stronger than the cross-polarized fields (912 and 914; 916 and 918; 920 and 922), respectively.

The antenna gain was also measured. It was found that its peak value at $\phi=0°$, $\theta=60°$ is 5.15 dBi.

In summary, an omnidirectional glass DRA with a building shape was investigated. The reflection coefficient, radiation pattern, and antenna gain of the DRA were measured. The glass DRA was found to have a wide impedance bandwidth of 36.5%. Omnidirectional radiation patterns have been observed across the impedance passband. Since the antenna is aesthetic, it can be used for home or office decorations. This is beneficial when one needs to hide an antenna due to psychological reasons, for example.

Depending on the dielectric used, it can constitute the entirety of the decoration or just a portion of it. For example, the dielectric could be solid or define a hollow portion of the decoration (e.g., where the decoration can be used as a container). The hollow portion could contain a solid or liquid, for example. Where only a portion of the decoration is primarily used as the dielectric for the antenna, the remainder could be used, or additions to the antenna could be made, to modify the antenna characteristics. For example, the remainder could comprise another dielectric. As another example, a metal could be embedded inside the dielectric to widen the bandwidth. As still another example, a parasitic conducting patch on the surface of a dielectric antenna can increase the bandwidth or change the field polarization from linear polarization to circular polarization.

The phrase "aesthetic dielectric antenna" refers to an aesthetically shaped (i.e., pleasing to the eye) decoration that includes a dielectric element as part of or integral with the decoration. The dielectric element, together with a means to excite the dielectric element, form the dielectric antenna. The presentation of the antenna as a decoration forms the "aesthetic" portion of the phrase. To an unknowing observer, an aesthetic dielectric antenna is merely a decoration, and only upon close inspection would one knowing what to look for identify the decoration as an antenna.

The substrate on which the decoration sits (directly or indirectly) can be of any material commonly used. For example, a commonly used substrate material for electronics is called duroid. It is random glass fiber reinforced PTEF or ceramic filled PTEF materials. PTEF is a soft, waxy, thermoplastic fluoropolymer. Another common material is FR4, which is a composite material of woven fiberglass cloth with an epoxy resin binder that is flame resistant. The substrate may be covered with an aesthetically pleasing layer through which coupling fields to the antenna can pass. For example, decorative plastic, wood, cloth, etc. could be used. In that case, the feeding means to the dielectric can be made to pass through the decorative covering.

The dielectric can be excited using any excitation methods, including but not limited to probe feed, and slot coupling with a microstripline or coaxial feedline, direct microstrip feedline, coplanar feed, soldered-through probe, slotline, stripline, conformal strip, dielectric image guide, metallic or substrate-integrated waveguides.

While several aspects of the present invention have been described and depicted herein, alternative aspects may be effected by those skilled in the art to accomplish the same objectives. For example, the information carried by the radiation pattern may be digital or analog in nature. Accordingly, it is intended by the appended claims to cover all such alternative aspects as fall within the true spirit and scope of the invention.

The invention claimed is:

1. A dielectric antenna, comprising:

at least one swan-shaped dielectric having a dielectric constant of more than 1;

a substrate on which the at least one swan-shaped dielectric is situated; and means electronically coupled via the substrate to the at least one swan-shaped dielectric for exciting the dielectric to emit a radiation pattern for carrying information, wherein each of the at least one swan-shaped dielectric is a three-dimensional aesthetically decorative shaped sculpture or artwork;

wherein the at least one swan-shaped dielectric comprises a stationary swan having a head, a beak, an S-shaped neck, a pair of wings, a body and a tail, wherein an overall height of the swan-shaped dielectric is approximately equal to an overall length thereof from a tip of the beak to a tip of the tail, wherein a length from an outermost point of a base of the neck to the tip of the tail comprises approximately 86.5% to approximately 88.5% of the overall height and overall length, wherein a height from a tip of the wings to a bottom surface of the body comprises approximately 77.4% to about 79.2% of the overall height and overall length, wherein a height from a top of the head to a top the neck comprises approximately 2.2% to about 2.3% of the overall height and overall length, wherein a height from the tip of the beak the top of the head comprises approximately 20.3% to about 20.8% of the overall height and overall length, wherein a height from the bottom surface of the body to the tip of the tail comprises approximately 24.8% to about 25.4% of the overall height and overall length, wherein a width of the head comprises approximately 9.8% to about 10% of the overall height and overall length, Wherein a width from wing tip to wing tip comprises approximately 42.9% to about 43.8% of the overall height and overall length, wherein a width from an inner surface of one wing to an inner surface of the other wing comprises approximately 32.3% to about 33.1% of the overall height and overall length, wherein a width of the base of the neck comprises approximately 9.8% to about 10% of the overall height and overall length, wherein a width of the bottom surface of the body comprises approximately 25.6% to about 26.2% of the overall height and overall length, wherein a width of each wing comprises approximately 7.5% to about 7.7% of the overall height and overall length, wherein a width of the body comprises approximately 38.3% to about 39.2% of the overall height and overall length, and wherein when excited the swan-shaped dielectric resonates at about 1.83 GHz and in a frequency band of about 1.57 GHz to about 2.16 GHz.

2. The dielectric antenna of claim 1, wherein the at least one swan-shaped dielectric comprises a solid dielectric.

3. The dielectric antenna of claim 1, wherein the means for exciting comprises a feedline on the substrate.

4. The dielectric antenna of claim 3, wherein the substrate comprises a slot for exciting the at least one shaped dielectric.

5. The dielectric antenna of claim 1, wherein the means for exciting comprises at least one of a probe feed, and slot coupling with a microstripline or coaxial feedline, direct microstrip feedline, coplanar feed, soldered-through probe, slotline, stripline, conformal strip, dielectric image guide, metallic or substrate-integrated waveguides.

6. The dielectric antenna of claim 1, wherein the radiation pattern comprises an omnidirectional radiation pattern.

7. The dielectric antenna of claim 1, wherein the radiation pattern comprises a broadside radiation pattern.

8. The dielectric antenna of claim 1, wherein the dielectric antenna comprises a dielectric resonator antenna.

9. The dielectric antenna of claim 1, wherein the at least one swan-shaped dielectric comprises glass.

10. The dielectric antenna of claim 1, wherein the at least one swan-shaped dielectric comprises crystal.

11. The dielectric antenna of claim 1, wherein the at least one swan-shaped dielectric comprises ceramic.

12. The dielectric antenna of claim 1, wherein the at least one swans gaped dielectric comprises porcelain.

13. A method of discretely emitting a radiation pattern capable of carrying information, the method comprising:

providing a dielectric antenna comprising:

at least one swan-shaped dielectric having a dielectric constant of more than 1;

a substrate on which the at least one swan-shaped dielectric is situated; and means electronically coupled via the substrate to the at least one swan-shaped dielectric for exciting the dielectric to emit a radiation pattern for carrying information, wherein each of the at least one swan-shaped dielectric is a three-dimensional aesthetically decorative shaped sculpture or artwork; and exciting the at least one swan-shaped dielectric with the exciting means to emit a radiation pattern capable of carrying information;

wherein the at least one swan-shaped dielectric comprises a stationary swan having a head, a beak, an S-shaped neck, a pair of wings, a body and a tail, wherein an overall height of the swan-shaped dielectric is approximately equal to an overall length thereof from a tip of the beak to a tip of the tail, wherein a length from an outermost point of a base of the neck to the tip of the tail comprises approximately 86.5% to approximately 88.5% of the overall height and overall length, wherein a height from a tip of the wings to a bottom surface of the body comprises approximately 77.4% to about 79.2% of the overall height and overall length, wherein a height from a top of the head to a top of the neck comprises approximately 2.2% to about 2.3% of the overall height and overall length, wherein a height from the tip of the beak the top of the head comprises approximately 20.3% to about 20.8% of the overall height and overall length, wherein a height from the bottom surface of the body to the tip of the tail comprises approximately 24.8% to about 25.4% of the overall height and overall length, wherein a width of the head comprises approximately 9.8% to about 10% of the overall height and overall length, wherein a width from wing tip to wind tip comprises approximately 42.9% to about 43.8% of the overall height and overall length, wherein a width from an inner surface of one wing to an inner surface of the other wino comprises approximately 32.3% to about 33.1% of the overall height and overall length, wherein a width of the base of the neck comprises approximately 9.8% to about 10% of the overall height and overall length, wherein a width of the bottom surface of the body comprises approximately 25.6% to about 26.2% of the overall height and overall length, wherein a width of each wing comprises approximately 7.5% to about 7.7% of the overall height and overall length, wherein a width of the body comprises approximately 38.3% to about 39.2% of the overall height and overall length, and wherein when excited the swan-shaped dielectric resonates at about 1.83 GHz and in a frequency band of about 1.57 GHz to about 2.16 GHz.

14. The method of claim 13, wherein the at least one swan-shaped dielectric comprises a solid dielectric.

15. The method of claim 13, wherein the means for exciting comprises a feedline on the substrate.

16. The method of claim 15, wherein the substrate comprises a slot for exciting the at least one shaped dielectric, and wherein the feedline is situated within the slot.

17. The method of claim 13, wherein the means for exciting comprises at least one of a probe feed, and slot coupling with a microstripline or coaxial feedline, direct microstrip feedline, coplanar feed, soldered-through probe, slotline, stripline, conformal strip, dielectric image guide, metallic or substrate-integrated waveguides.

18. The method of claim 13, wherein the radiation pattern comprises an omnidirectional radiation pattern.

19. The method of claim 13, wherein the radiation pattern comprises a broadside radiation pattern.

20. The method of claim 13, wherein the dielectric antenna comprises a dielectric resonator antenna.

21. The method of claim 13, wherein the at least one swan-shaped dielectric comprises glass.

22. The method of claim 13, wherein the at least one swan-shaped dielectric comprises crystal.

23. The method of claim 13, wherein the at least one swan-shaped dielectric comprises ceramic.

24. The method of claim 13, wherein the at least one swan-shaped dielectric comprises porcelain.

25. A dielectric antenna, comprising:

at least one apple-shaped dielectric having a dielectric constant of more than 1;

a substrate on which the at least one apple-shaped dielectric is situated; and means electronically coupled via the substrate to the at least one apple-shaped dielectric for exciting the dielectric to emit a radiation pattern for carrying information, wherein each of the at least one apple-shaped dielectric is a three-dimensional aesthetically decorative shaped sculpture or artwork;

wherein the at least one apple-shaped dielectric comprises a body and a stem, the body increasing in width from a bottom surface to a widest width approximately two-thirds up the body, the width decreasing to a bottom of the stem, wherein a height of the body comprises approximately 65.3% of the widest width, wherein a height of the stem comprises approximately 26.7% of the widest width, wherein a width of the stem comprises approximately 14.7% of the widest width, wherein when excited, the apple-shaped dielectric resonates at about 2.25 GHz and in a frequency band about 2.08 GHz to about 2.38 GHz.

26. A method of discretely emitting a radiation pattern capable of carrying information, the method comprising:

providing a dielectric antenna comprising:

at least one apple-shaped dielectric having a dielectric constant of more than 1;

a substrate on which the at least one apple-shaped dielectric is situated; and means electronically coupled via the substrate to the at least one apple-shaped dielectric for exciting the dielectric to emit a radiation pattern for carrying information, wherein each of the at least one apple-shaped dielectric is a three-dimensional aesthetically decorative shaped sculpture or artwork; and exciting the at least one apple-shaped dielectric with the exciting means to emit a radiation pattern capable of carrying information;

wherein the at least one apple-shaped dielectric comprises a body and a stem, the body increasing in width from a bottom surface to a widest width approximately two-thirds up the body, the width decreasing to a bottom of the stem, wherein a height of the body comprises approximately 65.3% of the widest width, wherein a height of the stem comprises approximately 26.7% of the widest width, wherein a width of the stem comprises approximately 14.7% of the widest width, wherein when excited, the apple-shaped dielectric resonates at about 2.25 GHz and in a frequency band about 2.08 GHz to about 2.38 GHz.

27. A dielectric antenna, comprising:

at least one building-shaped dielectric having a dielectric constant of more than 1;

a substrate on which the at least one building-shaped dielectric is situated; and means electronically coupled via the substrate to the at least one building-shaped dielectric for exciting the dielectric to emit a radiation pattern for carrying information, wherein each of the at least one building-shaped dielectric is a three-dimensional aesthetically decorative shaped sculpture or artwork;

wherein the at least one building-shaped dielectric comprises a tip portion, a top tapered portion under the tip portion, an upper square portion under the top tapered portion, a cylindrical portion under the upper square portion, a lower square portion under the cylindrical portion and a tapered base portion under the lower square portion, wherein a height of the tip portion comprises approximately 24.7% of a height of the building-shaped dielectric, wherein a height of the top tapered portion comprises approximately 12.9% of the height of the building-shaped dielectric, wherein a width of the upper square portion comprises approximately 15.1% of the height of the building-shaped dielectric, wherein a height of the upper square portion comprises approximately 15.1% of the height of the building-shaped dielectric, wherein a width of the cylindrical portion comprises approximately 9.7% of the height of the building-shaped dielectric, wherein a height of the cylindrical portion comprises approximately 26.9% of the height of the building-shaped dielectric, wherein a width of the lower square portion comprises approximately 15.1% of the height of the building-shaped dielectric, wherein a height of the lower square portion comprises approximately 15.1% of the height of the building-shaped dielectric, wherein a width of the bottom surface of the tapered base portion comprises approximately 22.6% of the height of the building-shaped dielectric, and wherein a height of the tapered base portion comprises approximately 5.4% of the height of the building-shaped dielectric.

28. A method of discretely emitting a radiation pattern capable of carrying information, the method comprising:

providing a dielectric antenna comprising:

at least one building-shaped dielectric having a dielectric constant of more than 1;

a substrate on which the at least one building-shaped dielectric is situated; and means electronically coupled via the substrate to the at least one building-shaped dielectric for exciting the dielectric to emit a radiation pattern for carrying information, wherein each of the at least one building-shaped dielectric is a three-dimensional aesthetically decorative shaped sculpture or artwork; and exciting the at least one building-shaped dielectric with the exciting means to emit a radiation pattern capable of carrying information;

wherein the at least one building-shaped dielectric comprises a tip portion, a top tapered portion under the tip portion, an upper square portion under the top tapered portion, a cylindrical portion under the upper square portion, a lower square portion under the cylindrical portion and a tapered base portion under the lower square portion, wherein a height of the tip portion comprises approximately 24.7% of a height of the building-shaped dielectric, wherein a height of the top tapered portion comprises approximately 12.9% of the height of the building-shaped dielectric, wherein a width of the upper square portion comprises approximately 15.1% of the height of the building-shaped dielectric, wherein a height of the upper square portion comprises approximately 15.1% of the height of the building-shaped dielectric, wherein a width of the cylindrical portion comprises approximately 9.7% of the height of the building-shaped dielectric, wherein a height of the cylindrical portion comprises approximately 26.9% of the height of the building-shaped dielectric, wherein a width of the lower square portion comprises approximately 15.1% of the height of the building-shaped dielectric, wherein a height of the lower square portion comprises approximately 15.1% of the height of the building-shaped dielectric, wherein a width of the bottom surface of the tapered base portion comprises approximately 22.6% of the height of the building-shaped dielectric, and wherein a height of the tapered base portion comprises approximately 5.4% of the height of the building-shaped dielectric.

* * * * *

UNITED STATES PATENT AND TRADEMARK OFFICE

CERTIFICATE OF CORRECTION

PATENT NO. : 9,123,995 B2
APPLICATION NO. : 13/615121
DATED : September 1, 2015
INVENTOR(S) : Leung et al.

It is certified that error appears in the above-identified patent and that said Letters Patent is hereby corrected as shown below:

Column 8, Line 28: Claim 12, Delete "swan gaped" and insert -- swan-shaped --

Signed and Sealed this
Fifth Day of July, 2016

Michelle K. Lee

Michelle K. Lee
*Director of the United States Patent and Trademark Office*